US005121166A

United States Patent [19]

Miyamoto et al.

[11] Patent Number: 5,121,166

[45] Date of Patent: Jun. 9, 1992

[54] BELT TYPE TRANSFER DEVICE

[75] Inventors: Takayuki Miyamoto; Masahiko Itaya; Hisahiro Saito, all of Hachioji, Japan

[73] Assignee: Konica Corporation, Tokyo, Japan

[21] Appl. No.: 588,688

[22] Filed: Sep. 26, 1990

[30] Foreign Application Priority Data

Sep. 29, 1989 [JP] Japan ..... 1-256315

[51] Int. Cl.[5] ..... G03G 15/14; G03G 21/00

[52] U.S. Cl. ..... 355/281; 15/256.5; 355/299

[58] Field of Search ..... 355/271, 275, 277, 281, 355/296, 299, 300, 283, 212; 15/256.51, 256.5

[56] References Cited

U.S. PATENT DOCUMENTS 4,751,549 6/1988 Koizumi ..... 355/271 X
4,903,067 2/1990 Murayama et al. ..... 355/271 X

FOREIGN PATENT DOCUMENTS 60-69682 4/1985 Japan ..... 355/299
63-71876 4/1988 Japan .
63-202537 8/1988 Japan .
63-208080 8/1988 Japan .
1225979 8/1989 Japan .

*Primary Examiner*—A. T. Grimley
*Assistant Examiner*—Shuk Y. Lee
*Attorney, Agent, or Firm*—Jordan B. Bierman

[57] ABSTRACT

A transfer device of the type having a belt which is stretched around a driving roller and an electric potential-applied driven roller, whereby the transfer device transfers a toner image from an image carrier onto a recording paper, and conveys the recording paper. The cleaning device is positioned so that its blade contacts the belt at a point a little downstream of the point where the belt separates from the driving roller.

3 Claims, 2 Drawing Sheets

BELT TYPE TRANSFER DEVICE

BACKGROUND OF THE INVENTION

The present invention relates to a transfer device in an image forming apparatus and the like, and more particularly to improvements in a belt type transfer device.

There are several types of transfer devices which are used in an image forming apparatus and the like. One of them is a belt type transfer device to which a rotative transfer belt is provided and which is characterized in that: an image is transferred onto a transfer paper which is pinched by the surface of an image carrier and the rotative transfer belt.

In this type of transfer device, powdery toner tends to adhere to the outer surface of the transfer belt due to the influence of electric static charge which is given during the image transfer process. Since there is a fear of staining a transfer paper in this type of transfer device, the transfer belt is provided with an exclusive cleaning means so that the rotative belt surface can be cleaned.

A blade type cleaning device is adequate for the above-described belt type cleaning means as its structure is simple and further it can be installed in a small space.

However, it has become clear from the research and experiments conducted by the inventors, that the position in which the blade comes into contact with the transfer belt with pressure, has a great influence on the cleaning effect and the conveyance efficiency of the transfer belt, which is a problem when the blade type cleaning device is put into practical use.

SUMMARY OF THE INVENTION

The object of the present invention is to solve the problem described above and to provide a belt type transfer device which has a high cleaning efficiency without deteriorating the conveyance efficiency of the transfer belt itself.

The above-described object can be accomplished by a belt type transfer device comprising a transfer belt stretched between a drive roller and ar idle roller upon which electric potential is impressed, wherein a toner image on a photoreceptor is transferred onto a recording paper by the action of the transfer belt, and comprising a cleaning means which is provided to the surface of the transfer belt, the blade of which slidably comes into contact with the transfer belt at the position which is located in the down stream portion of belt movement with regard to the position where the transfer belt departs from the above-described drive roller surface, wherein the distance between the contact point of the cleaning blade and the above-described transfer belt departing point is 0 to 4mm.

DESCRIPTION OF THE PREFERRED EMBODIMENTS

Figure 1:
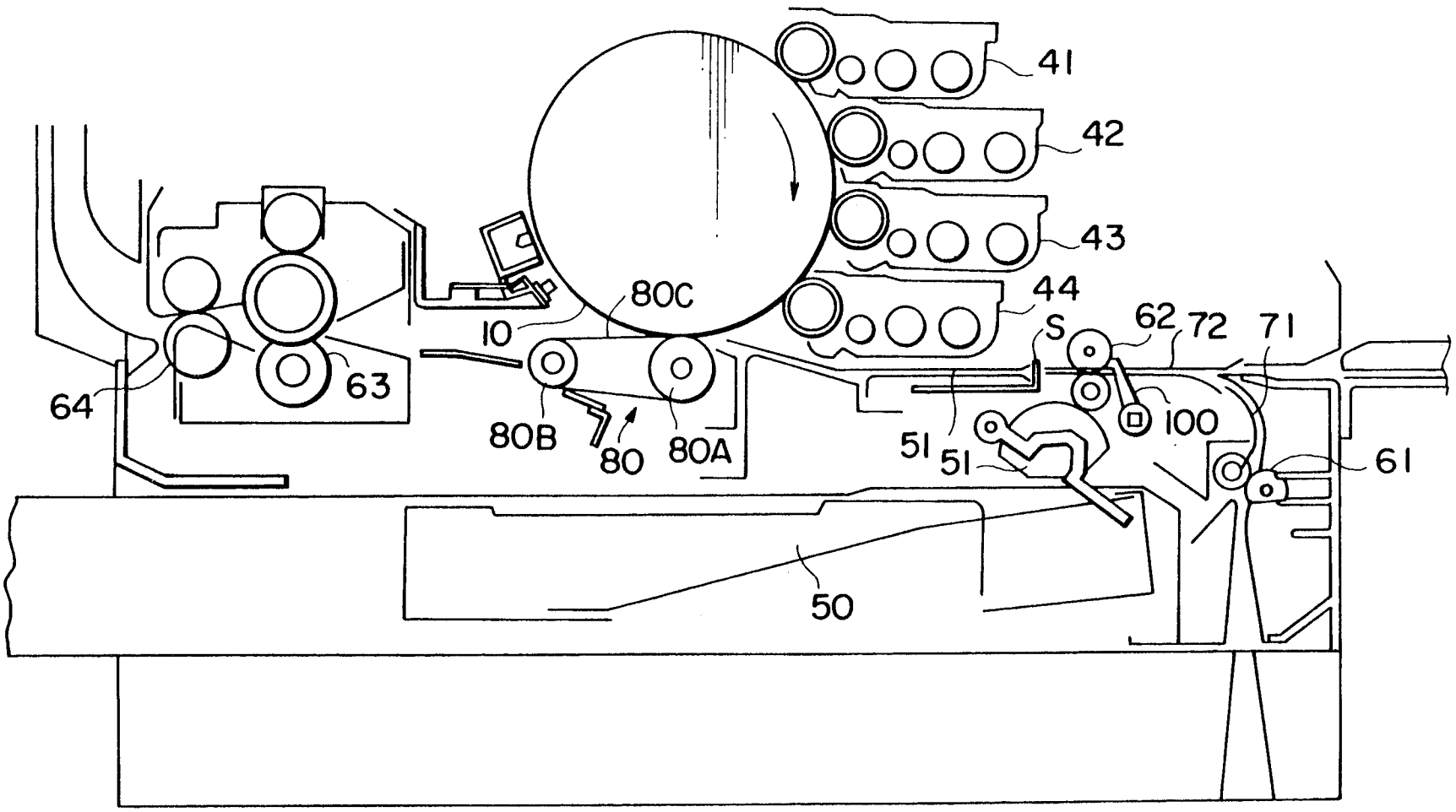
FIG. 1 is a partial sectional view of an image forming apparatus provided with the belt type transfer device of the present invention.
Figure 2:
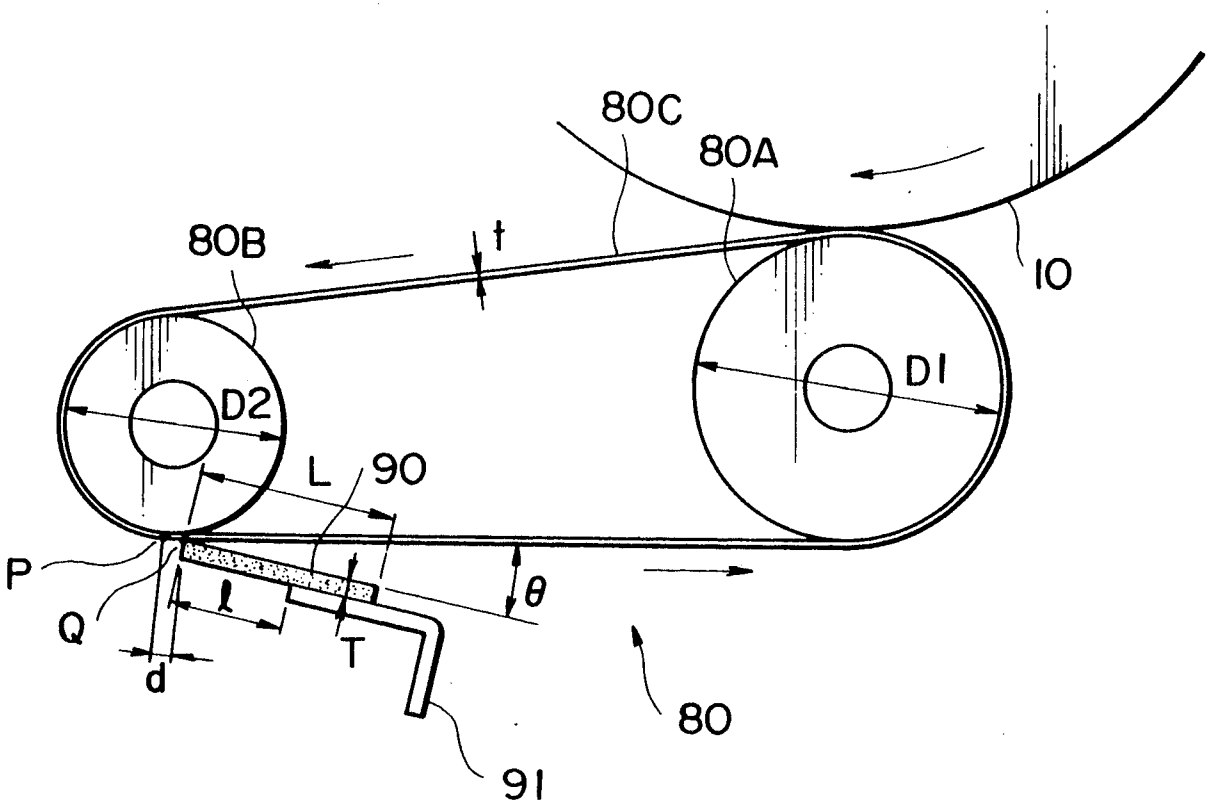
FIG. 2 is an enlarged view of the main portion of the belt type transfer device.

FIG. 1 and FIG. 2 show an example of the present invention.

FIG. 1 is a schematic illustration which shows the recording paper conveyance path in a color image forming apparatus.

The numeral 10 is a photoreceptor drum. The numerals 41, 42, 43, and 44 are developing unit in which the toners of magenta, yellow, cyan, and black are contained. The processes of charging, exposure, and development are repeatedly conducted each time when the above-described photoreceptor drum 10 is rotated. The image of each color is developed by each developer described above, and a color toner image is formed on the photoreceptor drum 10 by registrating toner images of each color.

The numeral 50 is a paper cassette. The numeral 51 is a separation roller by which the uppermost recording paper in the paper cassette 50 is separated from the stack in order to be conveyed one sheet by one sheet.

The numeral 61 is the first paper feed roller and the numeral 62 is the second paper feed roller, and both of them are always rotated. The numerals 71 and 72 are paper feed guides, the shape of which is an arc and a line respectively.

A recording paper sent from the above-described recording paper cassette 50, is conveyed along the paper feed guide 71 by the first paper feed roller 61 so that the recording paper can be reversed. After that, the recording paper comes into contact with the raised portion of paper feed shutter S which crosses the passage in the paper feed guide 72 so that the paper can be stopped. In this case, the above-described second paper feed roller 62 keeps rotating while it slips on the surface of the recording paper which is stopped by shutter S.

When a color toner image is formed on the surface of the photoreceptor drum 10, paper feed shutter S is withdrawn synchronously with image formation and the recording paper is moved along the paper feed guide. Then, the recording paper is pinched by the belt of the transfer device 80 and the photoreceptor drum 10 so that the above-described toner image can be transferred onto the recording paper. After transferred, the recording paper is conveyed by the transfer belt 80C while it is stuck on the surface of the transfer belt 80C. The transfer device 80 is controlled in such a manner that: while a color image is being formed on the photoreceptor drum 10, the transfer device 80 is separated from the surface of the photoreceptor drum 10; and just before image transfer is started, the transfer device 80 comes into contact with the photoreceptor drum 10.

A fixing unit is located in the down stream portion of document movement. The document onto which an image is transferred, is conveyed to the fixing unit by the transfer belt 80C, and the toner image is fixed on the recording paper by the fixing roller 63. After the image was fixed, the recording paper is conveyed by a pair of paper delivery rollers 64 and delivered to the upper portion of the apparatus body or to the left.

The above-described belt type transfer device is illustrated in FIG. 2.

In FIG. 2, the numeral 80 is a belt type transfer device. The numeral 80A is a transfer roller which is a rotatable idle roller made from metal and which is electrically charged when electrical potential is impressed upon the roller. The numeral 80B is a drive roller which is rotated by the drive power source of the apparatus. The numeral 80C is a flexible transfer belt with high resistance which is stretched between the above-described transfer roller 80A and the drive roller 80B. The transfer belt 80C is composed in such a manner that: a rubber belt with conductive cloth is used as a base; and a thin flexible high resistance layer or an insulating layer is provided to the outer surface of the belt.

The above-described transfer roller 80A is pivotally provided to a member (not illustrated in the drawing) which can be oscillated around the axis of the drive roller 80B, and the transfer roller 80A is pushed toward the photoreceptor drum 10 so that it can be pressed against the circumferential surface of the photoreceptor drum 10 and so that the transfer roller 80A can be withdrawn, wherein the above-described transfer belt 80C is pinched by the transfer roller 80A and the photoreceptor drum 10. The transfer device 80 is pressed against and withdrawn from the photoreceptor drum 10 under the control of a control unit provided to the image forming apparatus main body.

At least when the transfer roller 80A comes into contact with the photoreceptor drum 10, the above-described drive roller 80B is driven counterclockwise, and accordingly the transfer belt 80C and the transfer roller 80A are also rotated counterclockwise. At that moment, the transfer belt 80C is rotated by the drive roller 80B so that the speed of the outer surface of the transfer belt 80C can be the same as that of the circumferential speed of the photoreceptor drum 10.

The numeral 90 is a blade, which is a cleaning means made from urethane rubber. The numeral 91 is a blade holder which holds the blade 90, and which is composed in such a manner that: the tip of the above-described blade 90 is always made contact with the outer surface of the transfer belt 80C by the action of a resilient member (not illustrated).

The inventors made a plurality of experiments to study the contact position of the above-described blade 90 and the transfer belt 80B. According to the experiments, the following results could be obtained.

When the tip of the blade 90 slidably came into contact with the outer surface of the transfer belt 80C which was wound around the drive roller 80B, the load of the tip of the blade 90 was varied according to the roundness of the drive roller 80B, so that cleaning could not be uniformly conducted. Further, the length of the drive roller 80B and the length of the blade 90 exceeded 300mm, wherein the length of the blade was the length in the vertical direction with regard to the surface of the drawing. Therefore, it was difficult to set and maintain the blade 90 in parallel with the axis of the drive roller 80B, so that it was found that the unevenness of cleaning tended to occur on the outer surface of the transfer belt 80C.

Then, the tip of the blade 90 was set on the portion of the belt with which either roller did not come into contact so that the blade came into contact with the belt with pressure. It was found that the cleaning effect became unstable because the contact angle of the blade 90 to the transfer belt 80 was varied due to the dispersion of the belt itself and the distance of the rollers. In other words, when the contact angle of the blade 90 to the transfer belt 80C was small, the toner which stuck to the belt was not scraped off by the blade 90 and passed through between the blade 90 and the transfer belt 80C, so that the toner stuck to the belt as if it was kneaded and it was further difficult to remove the kneaded toner from the belt surface. On the other hand, when the contact angle was too large, the blade 90 came into contact with the belt 80C in the state of vibration, in other words in the state of chattering, and the belt surface was cleaned with stripes.

According to the results of the experiments explained above, the inventors took notice of the fact that the portion of the transfer belt 80C which had just departed from the surface of the drive roller 80B, was relatively stable. For that reason, the inventors studied the position of the contact point of the blade 90 with the belt 80C focusing their attention on the portion of the transfer belt 80C which had just departed from the surface of the drive roller 80A.

The members used in the experiments were as follows. The transfer roller 80A: the outside diameter D1=20ϕmm, and the length=330mm. The drive roller 80B: the outside diameter D=14.8ϕmm, and the length=330mm. The transfer belt 80C: the thickness t=0.6mm, and the width=310mm. The blade 90: the thickness T=2mm, and the width=310mm.

Position P on the transfer belt 80C is defined as the position where the transfer belt 80C is departed from the surface of the drive roller 80B, and position Q is defined as the position which is located in the downstream portion of belt movement, wherein the distance between position P and position Q is defined as d. The tip of the blade 90 was set at position Q and then the tip of the blade 90 was moved toward position Q in order to check the cleaning effect of the blade 90.

The results of the experiments were as follows. Almost sufficient cleaning effect was obtained in the range of d=0 to 4mm. Especially when the tip of the blade 90 was located at the middle position d=2mm, all the surface of the transfer belt 80C was uniformly and completely cleaned, and further the blade 90 did not affect the conveyance performance of the transfer belt 80B.

The blade 90 used in the experiments can be described as follows the total length L=15mm; the length of free portion l 32 9mm; and the contact angle with the transfer belt 80B $\theta=16°$ to 17°.

According to the results of the experiments explained above, the inventors further made various experiments under various conditions and it was found that: the most adequate contact position of the blade with the transfer belt is located at a portion on the belt which is a little downstream from the position where the belt is departed from the roller surface; the distance d=0 to 4mm; and when the blade of the cleaning means is set at the position described above, the transfer belt surface can be completely cleaned without being affected by the roundness of the drive roller and the dispersion of the transfer belt length.

EFFECT OF THE INVENTION

According to the present invention, the transfer belt, it was difficult to clean it, can be cleaned by an extremely simple cleaning means, and furthermore it can be cleaned by setting the cleaning blade at an adequate position on the transfer belt, without deteriorating the conveyance performance. As a result, the transfer belt can be always maintained clean, so that a belt type transfer device can be provided by which a transfer image of high quality can be obtained.

What is claimed is:

1. A transfer device for transferring a toner image from an image carrier onto a recording paper, said transfer device comprising;

a belt for conveying and pressing said recording paper onto said image carrier, said belt being stretched around a driving roller and a driven roller to which an electric potential is applied; and (b) cleaning apparatus for cleaning said belt, said cleaning apparatus remaining in press contact with an outer surface of said belt as a point 0 to 4mm downstream of the position where said belt separates from said driving roller.

2. The transfer device according to claim 1, wherein the cleaning apparatus keeps in press contact with the outer surface of the belt at a point 2mm downstream of the position where the belt separates from the driving roller.

3. The transfer device according to claim 1, wherein the cleaning apparatus always keeps in press contact with the belt at angle from 16 to 17 degrees against the direction of the belt.

* * * * *